US005736497A

United States Patent [19]

Steiner

[11] Patent Number: 5,736,497

[45] Date of Patent: Apr. 7, 1998

[54] PHOSPHORUS FREE STABILIZED ALKALINE PEROXYGEN SOLUTIONS

[75] Inventor: Norbert N. Steiner, Upper Saddle River, N.J.

[73] Assignee: Degussa Corporation, Ridgefield Park, N.J.

[21] Appl. No.: 624,218

[22] Filed: Mar. 29, 1996

Related U.S. Application Data

[63] Continuation-in-part of Ser. No. 435,963, May 5, 1995, abandoned.

[51] Int. Cl.[6] ..... C11D 3/39; C11D 3/395; C11D 7/08

[52] U.S. Cl. ..... 510/303; 510/309; 510/317; 510/318; 510/369; 510/372; 134/40

[58] Field of Search ..... 510/303, 309, 510/317, 318, 369, 372; 134/40

[56] References Cited

U.S. PATENT DOCUMENTS

| | | | |
|---|---|---|---|
| 3,811,833 | 5/1974 | Stalter | 8/111 |
| 3,852,210 | 12/1974 | Krezanoski | 252/95 |
| 3,996,151 | 12/1976 | Kirner | 252/186 |
| 4,025,453 | 5/1977 | Kravetz et al. | 252/102 |
| 5,089,162 | 2/1992 | Rapisarda | 252/102 |
| 5,130,053 | 7/1992 | Feasey et al. | 252/400.22 |
| 5,169,552 | 12/1992 | Wise | 252/95 |
| 5,180,517 | 1/1993 | Woods | 252/186.27 |
| 5,229,028 | 7/1993 | Boutique | 252/142 |
| 5,250,212 | 10/1993 | De Buzzaccarini et al. | 252/104 |
| 5,264,143 | 11/1993 | Boutique | 252/95 |
| 5,275,753 | 1/1994 | de Buzzaccarini | 252/95 |
| 5,415,796 | 5/1995 | Van Buskirk et al. | 252/95 |
| 5,437,886 | 8/1995 | Heffner et al. | 8/111 |
| 5,460,747 | 10/1995 | Gosselink et al. | 252/186.38 |
| 5,520,835 | 5/1996 | Sivik et al. | 252/102 |

FOREIGN PATENT DOCUMENTS

| | | |
|---|---|---|
| 0 376 704 | 7/1990 | European Pat. Off. . |
| 0 376 704 | 7/1990 | Germany . |
| 41 223 142 | 1/1993 | Germany . |
| 91/11388 | 8/1991 | WIPO . |
| 92/07057 | 4/1992 | WIPO . |
| 93/01270 | 1/1993 | WIPO . |
| 93/13012 | 7/1993 | WIPO . |

OTHER PUBLICATIONS

Chemical and Engineering News, 23 Jan. 1995, pp. 30–53.

*Primary Examiner*—Paul Lieberman
*Assistant Examiner*—Gregory R. Delcotto
*Attorney, Agent, or Firm*—Beveridge, DeGrandi, Weilacher & Young, L.L.P.

[57] ABSTRACT

A phosphorus-free and boron-free cleaning composition containing a phosphorus-free aqueous solution containing an active ingredient (e.g., hydrogen peroxide or a compound capable of releasing hydrogen peroxide under the conditions prevailing in use of the composition), at least one organic stannate which is a tetravalent tin complexed with dicarboxylic acid, hydroxy carboxylic acid, or tricarboxylic acid, and optionally at least one organic stabilizer which is a benzoate, a sulfonic acid or salt, or mixtures thereof. The active ingredient is hydrogen peroxide or a percarbonate. The aqueous solution has an alkaline pH.

23 Claims, No Drawings

PHOSPHORUS FREE STABILIZED ALKALINE PEROXYGEN SOLUTIONS

REFERENCE TO A RELATED APPLICATION

This is a continuation-in-part of my U.S. patent application Ser. No. 08/435,963 filed 5 May 1995, now abandoned, which is relied on and incorporated herein by reference in its entirety.

BACKGROUND OF THE INVENTION

The present invention relates to aqueous alkaline hydrogen peroxide formulations and in particular to stabilized phosphate-free and boron-free formulations.

In household laundry bleach, hard surface cleansers, and other cleanser formulations, aqueous alkaline hypochlorite solutions are typically employed for stain removal and disinfection. Such formulations are very effective, but chlorinaceous compounds may interact with dissolved and suspended organic material, forming carcinogens or other noxious substances. Furthermore, these hypochlorite-based compositions may cause fiber degradation, and may be incompatible with certain fabric dyes.

To remedy these disadvantages, manufacturers have developed environmentally benign alternatives based on acidic aqueous hydrogen peroxide solutions. These compositions are also fiber-safe and color-safe. Commercially available hydrogen peroxide solutions typically include a trace amount of phosphorus; the industry, however, promotes the use of compositions without any additional phosphorus-containing compounds. Furthermore, hydrogen peroxide ($H_2O_2$) is a product that is generally acceptable from a toxicological and environmental standpoint because its decomposition products are oxygen and water.

Hydrogen peroxide is typically stored with stabilizers since decomposition due to the presence of catalytically active substances is extremely difficult to prevent. For this reason, much study has gone into improving the storage characteristics of hydrogen peroxide and into the dynamics of the stabilization process.

Mixtures of stabilizers are frequently added to the hydrogen peroxide solution since the combined effect is sometimes better than the individual stabilizers. Also, other substances are sometimes added to the solution in order to maintain the surface of the container, particularly those of aluminum. For example, sulfate and chloride may degrade a aluminum container, so a small amount of nitrate may be added to the solution to prevent pitting the surface of the aluminum container.

After an extensive amount of research on stabilizers, stannates, oxines, and phosphorus-containing compounds, such as phosphate and phosphonic acid derivatives, appear to be the preferred stabilizers for hydrogen peroxide containing solutions. For example, tin compounds, specifically sodium stannate [$Na_2Sn(OH)_6$], have been known as peroxide stabilizers for many years and are widely used as stabilizers for acidic solutions (less than about pH 5).

The performance of these cleaning compositions can be improved, in particular the bleaching and stain removal, by formulating alkaline products. However, the commercial use of alkaline formulations has been hindered by the strong tendency of alkaline $H_2O_2$ solutions to decompose during storage. For example, under typical storage conditions, compositions containing a stannate compound may release hydroxyls which increase the pH and increase the decomposition rate. With excessive decomposition, the cleaning product loses its efficiency, its cleaning ability, and its storage life (shelf life).

The stability of aqueous alkaline $H_2O_2$ solutions has been improved by employing amino methylene phosphonic acid together with low weight alcohols as the stabilizer system (see, for example, GB 2072643, EP-B 0076166, and WO 91/09807). However, these alkaline compositions still suffer from decomposition and pH drift (toward an acidic pH), problems which have been addressed by incorporating cyclohexane 1,2 diamino methylene phosphonic acid and borate compounds as the buffer and stabilizer (see, for example, WO 93/13012).

Stable aqueous peroxygen solutions containing perborates and/or hydrogen peroxide in combination with acids (e.g., boric acid) have been stabilized with water-soluble carbazole sulfonates, diphenylamine sulfonates or N-phenylamino naphthalene sulfonates with or without DTPA (diethylenetriamine pentamethylene phosphonic acid). Although alkaline persalts are employed, the pH of the final solutions are described to be below 7 due to the addition of acids (see, for example, WO 91/11388).

However, with increasing concern and stronger restrictions on the addition of phosphorus and boron compounds into detergent/laundry products, it is preferable to have phosphorus-free and boron-free formulations without compromising effectiveness, stability, and safety.

Alkaline peroxygen solutions are described in EP 0376704 in which a phosphonate sequestrant or colloidal stannic oxide is utilized as a stabilizer for thickened alkaline $H_2O_2$ formulations. Also described are tin sulphate, sodium stannate, tin dichloride and tin tetrachloride as compounds which generate colloidal hydrous stannic oxide under alkaline conditions. However, organic compounds such as stannic oxalate or stannic tartrate are not disclosed or suggested.

SUMMARY OF THE INVENTION

In accordance with the invention, alkaline hydrogen peroxide solutions are stabilized by the addition of an organic stannate which is tetravalent tin complex with an acid such as dicarboxylic acid or hydroxy carboxylic acid or tricarboxylic acid. The stabilizers are environmentally safe and biodegradable. It was found that the combination of organic stannic compounds of di- and tri-carboxylic acids such as oxalic acid tin IV complexes are significantly more stable formulations at even higher concentrations than the individual stabilizers alone.

SPECIFIC DESCRIPTION OF THE INVENTION

In accordance with the invention, phosphorus-free and boron-free cleaning compositions comprise alkaline solutions containing hydrogen peroxide and/or a percarbonate, stabilized with an organic stannate.

According to the present invention, there is provided a storage stable composition suitable for use as household bleach and disinfectant compositions. The composition includes at least one active ingredient, such as an alkaline solution of hydrogen peroxide, sodium percarbonate, or combinations thereof. Preferably, the composition has an active oxygen content of between about 0.5% w/w and about 10% w/w. The cleaning composition also comprises at least one tin IV complex containing stabilizer, such as an organic stannic compound such as stannic oxalate or stannic tartrate. The composition typically will also include one or more pH adjusters to maintain an alkaline pH. Optionally, the composition may also include one or more surfactants, thickening agents, electrolytes, coloring agents, fragrances, or combinations thereof with other conventional additives.

As used herein, cleaning composition refers to industrial and household cleaning, bleaching, and/or disinfectant solutions. These compositions typically include an active ingredient, one or more stabilizers, one or more buffers, one or more surfactants, one or more thickening agents, one or more anti-redisposition agents, one or more coloring agents, and/or one or more fragrances.

As used herein, hydrogen peroxide refers to the compound per se, and to compounds which release hydrogen peroxide in solution under the conditions prevailing in the described process of using the cleaning composition, including but not limited to urea peroxide, sodium peroxide, calcium peroxide, magnesium peroxide, and other such compounds known in the art.

As used herein, the term "stannate" refers to any composition which forms stable soluble stannic compounds. Exemplary stannates include but are not limited to organic stannate complexes which are tetravalent tin IV complexes with dicarboxylic acids (DCA); e.g., of the formula $(Sn(DCA)_3)^2$. As used herein, the term "dicarboxylic acids" include for example saturated linear aliphatic dicarboxylic acids having the formula $HOOC(CH_2)_nCOOH$ where n=0–19 (especially n=0 –11) such as oxalic, malonic, succinic, glutaric, adipic, pimelic, suberic, azelaic, and sebacic acids. Additionally, dicarboxylic acids also include hydroxy dicarboxylic acids (HCA) such as tartaric, malic, tartronic, and phloinoic acids; e.g., $Sn(HCA)_3^2$. Dicarboxylic acids are generally described in Kirk-Other's *Encyclopedia of Chemical Technology,* (Third Edition), Volume 7, pages 614–628, phthalic acids are described in Kirk-Other's *Encyclopedia of Chemical Technology,* (Third Edition), Volume 17, pages 732–777, and hydroxy dicarboxylic acids are described in Kirk-Other's *Encyclopedia of Chemical Technology,* (Third Edition), Volume 13, pages 103–121; all of which are entirely incorporated herein by reference. Thus the organic stannate complexes include compounds such as stannic oxalate, stannic tartrate, and the like. The preferred stannates (IV) are those where the dicarboxylic acids are oxalic, adipic, succinic, glutaric or tartaric acids, and mixtures thereof.

Organic stannate complexes also include tin complexes with saturated cyclic dicarboxylic acids (e.g., 1,4 cyclo hexane dicarboxylic acid; 1,4 cyclo pentane dicarboxylic acid), saturated cyclic hydroxy carboxylic acids (e.g., 2 hydroxy cyclohexane carboxylic acid; 2 hydroxy cyclopentane carboxylic acid), benzene dicarboxylic acid, and acids of the following formulas:

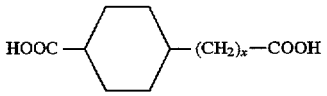

where x=0–20, preferably x≦10, more preferably x≦5 (e.g., 0, 1, 2, 3, 4, 5).

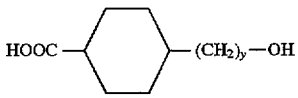

where y=1–20, preferably y≦10, more preferably y≦5 (e.g., 1, 2, 3, 4, 5).

Organic stannate complexes also include tin complexes with tricarboxylic acids (e.g., citric acid) and alpha hydroxy carboxylic acids (e.g., α, β hydroxy acids such as lactic acid; α or β hydroxy cyclohexane carboxylic acid). Examples of tin complexes which may be used in the present invention are found in Gmelin Handbuch der Anorganischen Chemie, Springer-Verlag, 1975, which is incorporated by reference in its entirety, especially pages 34–35, 75–81, and 223–227. Examples of such compounds include $Sn_2(C_2O_4)_7^{4-}$; $Sn(C_2O_4)_4^{4-}$; $Sn(C_2O_4)_m^{4-2m}$; and Sn(IV)oxalate.

In addition, Sn (II) complexes can be used which are immediately oxidized to the corresponding Sn (IV) complexes when mixed with $H_2O_2$ or a compound capable of releasing hydrogen peroxide under the conditions prevailing in use of the composition of the invention.

As used herein, pH adjuster refers to any compound used to achieve an alkaline pH of the cleaning composition, typically above about 7.5, and preferably from about 7.5 to about 11.0. When hydrogen peroxide is the active ingredient, exemplary pH adjusters include, but are not limited to, an alkali metal hydroxide, such as sodium hydroxide (NaOH) or potassium hydroxide (KOH); a carbonate or bicarbonate, such as sodium carbonate ($Na_2CO_3$) and baking soda ($NaHCO_3$); or a silicate, such as sodium silicate ($Na_2SiO_3$), or aqueous $NH_3$ solution. When the active ingredient is sodium percarbonate, exemplary pH adjusters include, but are not limited to, non-phosphorus containing acids, including inorganic acids, such as nitric acid ($HNO_3$), sulfuric acid ($H_2SO_4$); or organic acids or salts thereof, such as acetic acid or sodium acetate ($NaC_2H_3O_2$).

One skilled in the art will recognize that commercially available hydrogen peroxide solutions typically include a trace amount of phosphorus and/or boron. As used herein, the term "phosphorus-free" refers to a solution which does not contain any added compound which produces a phosphorus ion in solution or adds phosphorus ions to the solution. The solution will contain less than 15 ppm phosphorus. Likewise, the term "boron-free" as used herein refers to a solution which does not contain any added compound which produces a boron ion in solution. The solution will contain less than 1 ppm boron.

In practice, it is preferable to select the concentration of active ingredient so that the active oxygen range of the cleaning solution falls between about 0.5% and about 10%. For example, when hydrogen peroxide is the active ingredient, the active oxygen content will typically range from about 0.7% to about 4.1% (from about 1.6% $H_2O_2$ to about 8.0% $H_2O_2$ by weight). When sodium percarbonate is the active ingredient, the active oxygen content will typically range up to about 2% (sodium percarbonate itself is commercially available with an active oxygen content of 13–15%, but compositions containing it have lower active oxygen content due to its limited solubility).

The tin complex is added in the range from about 10 to about 1000 ppm Sn(IV), preferably from about 20 to about 500 ppm.

In selecting the amounts of stabilizers, the pH of the solution is preferably taken into account, the higher the pH, the higher the stabilizer concentration. The pH range should be alkaline (i.e., above 7), e.g., above about 7.5, preferably between about 8.5 and about 11.0, and most preferably between about 9.5 and about 10.5. The final pH of the formulation is adjusted by addition of pH adjusters, such as NaOH, KOH, $Na_2SiO_3$, $NaHCO_3$, $NH_3$, or sodium carbonate. In the case of the use of sodium percarbonate, preferably $H_2SO_4$, $HNO_3$, glacial acetic acid or baking soda ($NaHCO_3$) is employed for pH adjustment.

A composition according to the invention may also include, as noted above, surfactants. The concentration of surfactant are selected in the range from about 0.25% to about 25%. These surfactants are believed to improve the extent of wetting of the surface of the fibers or penetration into the fibers, enhancing the disinfection rate and bleaching performance. The surfactants may be selected from the group of nonionic surfactants, such as alkyl ether ethoxylates, amine oxides, alkyl ether sulfates; or anionic surfactants, such as sodium lauryl sulfate. Such surfactants and the amount used are known to and within the knowledge of one skilled in the art.

A composition according to the invention may also include, as noted above, a thickening agent which is stable to oxidation under alkaline conditions. It has been found that polymer-based products, such as polyacrylic acid copolymers (e.g. Carbopol 934, 1623, 1610) provide the best stability. Typically, these thickening agents are added in a concentration of from about 0.25% to about 2.0%. Such thickening agents and the amount used are known to and within the knowledge of one skilled in the art.

A composition according to the invention may also include, as noted above, a fragrance compatible with alkaline cleaning solutions, typically in a concentration of from about 0.03% to about 0.5% w/w. Such fragrances and the amount used are known to and within the knowledge of one skilled in the art. Fluorescent whitening agents may also be added in the amount, for example, of 0.1 to 1.0% by weight.

EXAMPLES

In the following examples, various compositions were tested and compared according to a stability rating (in %), as follows:

| Accelerated Stability Test (16 hrs 96° C.) | | Room Temperature (5 weeks) | | 40° C. (5 weeks) | |
|---|---|---|---|---|---|
| 100–75 | excellent | 100–95 | excellent | 100–80 | excellent |
| 74–30 | good | 94–85 | good | 79–60 | good |
| 29–10 | moderate | 84–75 | moderate | 59–30 | moderate |
| <9 | poor | <74 | poor | <29 | poor |

The following tests were performed:

STABILITY TESTS 1. 96° C./16 hrs Tests

The formulation (50 ml) is heated at 96° C. in a 50 ml volumetric flask for 16 hrs. The stability is expressed as the percentage of residual $H_2O_2$.

2. 40° C. and 20° C. Tests

The formulations were stored in an oil bath at constant temperature in tightly sealed polyethylene bottles for a defined storage period (e.g., six weeks). The stability is expressed as the percentage of residual $H_2O_2$ after the defined storage period.

SOAKING TESTS

1. Soaking in diluted bleach solutions: 50 g of stained cotton swatches were immersed in 1000 ml of tap water at 20° C. The corresponding amount of bleaching agents were added under stirring. After 24 hrs bleaching time, the swatches were rinsed with tap water and air dried. Brightness (ISO % reflectance; 457 nm) was measured using a Elephro Data Color 2000 spectrophotometer. Brightness increase is calculated as the percentage of the brightness gain compared to the initial brightness of the original stained swatches:

$$\text{brightness increase (\%)} = \frac{(\text{brightness after bleach}) - \text{initial brightness}}{\text{initial brightness}} \times 100$$

2. Soaking Application with concentrated bleach solutions: 2×2 inch stained cotton swatches were wetted with 10 ml bleach product at room temperature for 30 minutes. Brightness increase was determined as described above.

Active oxygen was determined by "Iodometric Determination of Hydrogen Peroxide".

Example 1

Stability of 2% $H_2O_2$ Solutions

TABLE 1

| Stabilzers (ppm 100%) | | | Stability (%) |
|---|---|---|---|
| $Na_2Sn(OH)_6$ | Trisoxalato stannate IV | pH (NaOH) | 16 hrs, 96° C. |
| — | 1000 | 10.0 | 86.8 |
| 1000 | — | 10.0 | 71.1 |

Example 2

Stability of 3.5% $H_2O_2$ Solutions

TABLE 2

| Stabilizers (ppm 100%) $Na_2Sn(OH)_6$ | $Na_2Sn(C_2O_4)_3$ | pH (NaOH) | Stability (%) 16 hrs, 96° C. |
|---|---|---|---|
| 100 | — | 9.5 | 53.2 |
| 200 | — | 9.5 | 55.4 |
| — | 100 | 9.5 | 88.8 |

Example 3

Stability of 5% $H_2O_2$ Solutions

TABLE 3

| pH (NaOH) | $Na_2Sn(C_2O_4)_3$, ppm | Stability; 16 hrs, 96° C. |
|---|---|---|
| 8.0 | 1000 | 96.9 |
| 9.0 | 1000 | 83.8 |
| 9.5 | 1000 | 62.7 |
| 10.0 | 1000 | 30.8 |

Example 4

Stability of 2% $H_2O_2$ Solutions

TABLE 4

| pH (NaOH) | Stabilizer | Stability; 15 weeks, 40° C. |
|---|---|---|
| 10.5 | 1000 ppm $Na_2Sn(C_2O_4)_3$ | 85.8 |
| 10.5 | 1000 ppm $Na_2Sn(OH)_6$ | 75.3 |

Example 5

Stability of 2% $H_2O_2$ Solution (16 Hours, 96° C.)

TABLE 5

| pH | $Na_2Sn(C_2O_4)_3$ (ppm) | Alkali Source | Stability (%) 96° C., 16 hours |
|---|---|---|---|
| 10.0 | 1000 | $Na_2SiO_3$ | 12.2 |
| 10.0 | 1000 | $Na_2CO_3$ | 20.6 |
| 9.8 | 1000 | $Na_2CO_3$ | 38.7 |

Example 6

Stability of 5% $H_2O_2$ Solutions

TABLE 6

| pH (NaOH) | Stabilizer (ppm) | Stability (%) 16 hrs, 96° C. |
|---|---|---|
| 9.5 | $Na_2Sn(OH)_6$ (100) | 53.2 |
| 9.5 | $Na_2Sn(OH)_6$ (200) | 55.4 |
| 9.5 | $Na_2Sn(C_2O_4)_3$ (100) | 88.8 |
| 9.5 | $Na_2Sn(glut.)_3$ (100) | 86.9 |
| 9.5 | $Na_2Sn(adipic)_3$ (100) | 89.1 |
| 9.5 | $Na_2Sn(tartaric)_3$ (100) | 89.2 |
| 9.5 | $Na_2Sn(citric)_3$ (100) | 84.1 |

The acids in the stabilizers in tables 1–6 can be substituted by other acids in the tin IV complex.

Example 7

Stability of 3.5% $H_2O_2$ with Carboxylic Acids at pH 10.0 (NaOH)

| Stabilizer (conc. in ppm) | Stability (%) 16 hrs, 96° C. |
|---|---|
| oxalic acid, 1000 ppm | <1 |
| adipic acid, 1000 ppm | 1.9 |
| citric acid, 1000 ppm | <1 |
| tartaric acid, 1000 ppm | <2.1 |
| none | <1 |

The above data show that the acids alone do not stabilize $H_2O_2$. it is only the tin IV complex with the acid that stabilizes $H_2O_2$.

Example 8

| Liquid Bleach Formulation (P-free), thickened | |
|---|---|
| 7.0 g | $H_2O_2$ 50% |
| 0.8 g | Carbopol 934 |
| 0.05 g | Stabilizer ($Na_2Sn(C_2O_3)_3$) |
| 3.09 g | Surfactant (amine oxide) |
| Balance to 100 g | NaOH (pH 10) + DI water |
| Stability (16 hrs, 96° C.): | 31.1% |

Example 9

| Liquid bleach formulation | |
|---|---|
| 70 g | $H_2O_2$ 50% unstabilized |
| 0.1 g | $Na_2Sn(C_2O_4)_3$ |
| 3.0 g | Lauramine oxide (30%, Stepan Ammonyx LO) |
| 1.0 g | Polyvinylpyrrolidone (BASF K30) |
| 2.0 g | Alcohol ethoxylate (Shell 23-5) |
| Balance to 100 g: | NaOH (pH 10.0) and DI water |
| Stability at 40° C. for 8 weeks: | 91.3% |

Table 7 displays the results of a soaking test at a liquor ratio of 1:20 obtained with a commercial color-safe bleach product and the formulation of example 9 at pH 10 with the same $H_2O_2$ content (3.5%). With the exception of cocoa stain, significantly higher brightness levels could be achieved with the formulation of example 9. The reason for the only moderate response to bleaching/stain removal of the cocoa stain is its lipophilic character.

TABLE 7

Comparison of bleaching results (% stain removal); soaking tests 16 hrs, RT., liquor ratio 1:20, 240 ppm AO (active oxygen)

| Stain | Commercial color-safe bleach with 3.5% $H_2O_2$ | Formulation acc. Example 9 |
|---|---|---|
| Wine | 31.9 | 47.0 |
| Tea | 8.0 | 20.1 |
| Grass | 91.8 | 130.7 |
| Blueberry | 59.8 | 92.4 |
| Cocoa | 23.5 | 27.7 |

The data displayed in Table 8 clearly show that the alkaline formulation (pH 10) of example 9 outperforms the acidic (pH 4.5) commercial color-safe bleach. Typically, three times higher brightness gains were achieved with the formulation of example 9.

TABLE 8

Comparison of bleaching results (% stain removal); direct application of undiluted products, RT. 30 min.

| Stain | Commercial color-safe bleach with 3.5% $H_2O_2$ | Formulation acc. Example 9 |
|---|---|---|
| Wine | 34.5 g | 95.80 |
| Tea | 12.3 | 40.0 |
| Grass | 62.6 | 134.6 |
| Blueberry | 56.7 | 157.6 |
| Cocoa | 38.3 | 97.3 |

Preparation of Tris Oxalato Stannate IV

To 100 g of a 4.4% sodium stannate solution, 5.4 g of oxalic acid are added at Rt. The pH is then adjusted to 4.2 with NaOH. The solution is then added to the $H_2O_2$ solution before pH adjustment to the alkaline range.

Preparation of Tris Tartrato Stannate IV

To 10 g of sodium stannate in 1000 g DI water, 20.5 g of tartaric acid are added slowly. The pH is adjusted to 4.2 with NaOH.

Preparation of Tris Adipato Stannate IV

Due to the low solubility of adipic acid the complex is preferably formed in-situ. To 1000 g 5% $H_2O_2$ solution 0.9 g of adipic acid is added, then slowly 8.8 g of a 5% sodium stannate solution is added slowly. The pH of the peroxide solution is then adjusted to the desired level with an alkaline compound.

Example 10

5% $H_2O_2$ Solution

To 50 g of 5% unstabilized $H_2O_2$ 400 g of deionized water were added. Then 23.0 g of tris oxalato stannate IV stabilizer solution (described under 1) is added. The pH of the $H_2O_2$ solution is adjusted with 5% NaOH to 10.0 and deionized water is added to reach a total of 500.0 g. Stability at 96° C. for 16 hrs is 30.8%.

Example 11

2% $H_2O_2$ Solution

To 20 g of 50% unstabilized $H_2O_2$ solution, 450 g of deionized water is added, then 23.0 g of tris oxalato stannate IV solution is added. The pH of the solution is adjusted with 5% NaOH to 10.0 and DI water is used to reach a total of 500 g. Stability at 96° C. for 16 hrs is 86.8%.

Example 12

5% $H_2O_2$ Formulation, Thickened

To 900 g of 5.5% $H_2O_2$ containing 1000 ppm trisoxalato stannate IV, 100 g of a 30% lauramine oxide solution was added. Then 8 g of Carbopol 934 polymer were added under vigorous stirring. The pH of the mixture was adjusted to 10.0 with 10% NaOH.

The sample was split and stored in closed polyethylene bottles at room temperature(21°–24° C.) and 40° C., respectively, over a period of 3 months. The active oxygen content was determined by titration with 0.1 N cerium sulfate.

The results (residual $H_2O_2$, AO loss in parenthesis) are as follows:

| Storage Time (days) | RT. | 40° C. |
|---|---|---|
| 0 | 4.88 (0) | 4.88 (0) |
| 7 | 4.82 (1.2) | — |
| 20 | — | — |
| 62 | — | 4.58 (6.2) |
| 95 | 4.64 (4.9) | 4.15 (14.9) |

The stability of the formulation at 96° C. for 16 hrs was 68.5%.

Further variations and modifications of the foregoing will be apparent to those skilled in the art and such variations and modifications are attended to be encompassed by the claims that are appended hereto.

I claim:

1. A phosphorus-free and boron-free, storage stable cleaning composition comprising phosphorus-free aqueous solution containing a sufficient amount of an active ingredient to function as a cleaning composition, said active ingredient comprising hydrogen peroxide or a compound capable of releasing hydrogen peroxide under the conditions prevailing in use of said composition from about 10 to about 1000 parts per million of at least one organic tetravalent tin complexed with dicarboxylic acid, hydroxy carboxylic acid, or tricarboxylic acid present in an amount sufficient to stabilize an alkaline solution of hydrogen peroxide; said aqueous solution having an alkaline pH.

2. The composition according to claim 1, wherein said active ingredient comprises an active oxygen content from about 0.5% w/w to about 10% w/w.

3. The composition according to claim 1, wherein said complex present in said composition is a complex with a dicarboxylic acid which is a member selected from the group consisting of oxalic acid, succinic acid, adipic acid, glutaric acid, tartaric acid, and mixtures thereof.

4. The composition according to claim 1, wherein said complex present in said composition is a complex with citric acid.

5. The composition according to claim 1, wherein said complex present in said composition is a complex with alpha hydroxy carboxylic acid.

6. The composition according to claim 5, wherein said alpha hydroxy carboxylic acid is a α, β hydroxy acid.

7. The composition according to claim 6, wherein said α, β hydroxy acid is lactic acid.

8. The composition according to claim 1, wherein said complex present in said composition is a complex with an α, β hydroxy cyclohexane carboxylic acid.

9. The composition according to claim 1, further comprising a sufficient amount of a pH adjuster to maintain said composition at an alkaline pH.

10. The composition according to claim 9, wherein said pH adjuster is one or more compounds selected from the group consisting of an alkali metal hydroxide, soda ash, a carbonate, a silicate, nitric acid, sulfuric acid, acetic acid, baking soda, $NH_3$ and mixtures thereof.

11. The composition according to claim 1, wherein the concentration of said tin complex is between about 10 ppm and about 1000 ppm.

12. The composition according to claim 9, wherein the amount of pH adjuster is sufficient to produce a pH from about 8.5 to about 11.

13. The composition according to claim 9, wherein the amount of pH adjuster is sufficient to produce a pH from about 9.5 to about 10.5.

14. The composition of claim 1, further comprising at least one member selected from the group consisting of a surfactant, a thickening agent, a buffer, a coloring agent, a fragrance, and mixtures thereof.

15. The composition according to claim 14, wherein said surfactant comprises up to about 25% by weight.

16. The composition according to claim 14, wherein said surfactant is at least one member selected from the group consisting of a alkyl benzene sulfonate, an alkylether ethoxylate, an alkylether sulfate, an amine oxide, and mixtures thereof.

17. The composition according to claim 14, wherein said thickening agent comprises at least 0.25% by weight.

18. The composition according to claim 14, wherein said thickening agent is a polyacrylic or polyethylene polymer.

19. The composition according to claim 1, wherein said compound capable of releasing hydrogen peroxide under the conditions prevailing in use of said composition is urea peroxide, sodium peroxide, calcium peroxide, magnesium peroxide, or mixtures thereof.

20. The composition according to claim 1, wherein said complex present in said composition is a complex with a saturated linear aliphatic dicarboxylic acid having the formula $HOOC(CH_2)_nCOOH$ where n=0–19 a hydroxy dicarboxylic acid, a saturated cyclic dicarboxylic acid, a benzene dicarboxylic acid, or an acid of the following formulas:

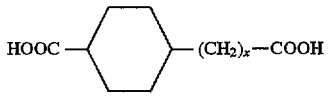

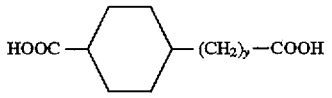

21. A phosphorus-free and boron-free, storage stable cleaning composition comprising:

an aqueous solution containing a sufficient amount of an active ingredient to function as a cleaning composition, said active ingredient having an active oxygen content from about 0.5% to about 10% w/w and comprising hydrogen peroxide or a compound capable of releasing hydrogen peroxide under the conditions prevailing in use of said composition;

from about 10 to about 1000 parts per million of at least one organic tetravalent tin complexed with dicarboxylic acid, hydroxy carboxylic acid or tricarboxylic acid present in an amount sufficient to stabilize an alkaline solution of hydrogen peroxide;

at least one pH adjuster comprising an alkali metal hydroxide, soda ash, a carbonate, a silicate, nitric acid, sulfuric acid, or baking soda present in an amount sufficient to maintain said composition at an alkaline pH.

22. A method for cleaning a surface in need thereof comprising applying to said surface an effective amount of an alkaline solution containing the phosphorus-free and boron-free cleaning composition according to claim 1.

23. A method for bleaching cloth and stain removal comprising applying to said cloth in need thereof an effective amount of an alkaline solution containing the phosphorus-free and boron-free cleaning composition according to claim 1.

* * * * *